United States Patent [19]

Grimm

[11] Patent Number: 4,564,162

[45] Date of Patent: Jan. 14, 1986

[54] TRACK INTERSECTION FOR TOY TRAINS

[75] Inventor: Thomas H. Grimm, Manhattan Beach, Calif.

[73] Assignee: Mattel, Inc., Hawthorne, Calif.

[21] Appl. No.: 568,663

[22] Filed: Jan. 6, 1984

[51] Int. Cl.[4] ..... E01B 7/00

[52] U.S. Cl. ..... 246/432; 446/447; 246/415 A

[58] Field of Search ..... 446/444, 445, 446, 447, 446/467; 238/10 R, 10 A, 10 B, 10 C, 10 E, 10 F; 104/DIG. 1; 246/421, 432, 457, 415 A

[56] References Cited

U.S. PATENT DOCUMENTS

| | | | |
|---|---|---|---|
| 2,254,153 | 8/1941 | Larrabee | 446/444 |
| 2,794,296 | 6/1957 | Field | 446/444 |
| 4,147,351 | 4/1979 | Saito | 446/446 X |

*Primary Examiner*—Mickey Yu

*Attorney, Agent, or Firm*—Melvin A. Klein; Ronald M. Goldman

[57] ABSTRACT

A toy train set includes a toy train car operative upon a two rail trackway. The trackway includes a braking system for reducing the toy train speed at selected places along the trackway and a track intersection having no moving parts which permits a child user to select either of two direction paths. An elongated beam spring is provided on the toy cars to facilitate placement upon the trackway by a younger child.

2 Claims, 12 Drawing Figures

FIG. 1a
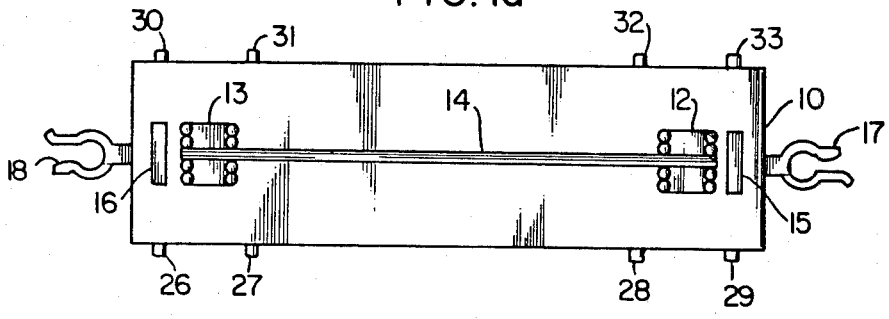
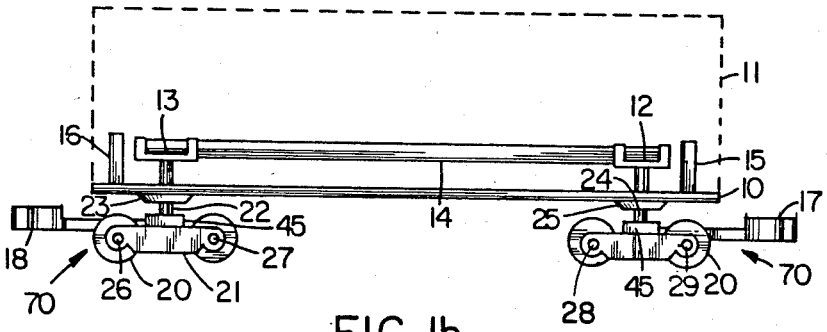
FIG. 1b
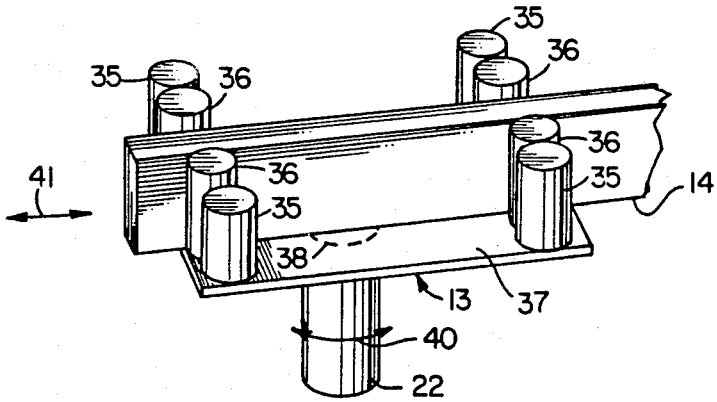
FIG. 1c

FIG. 8
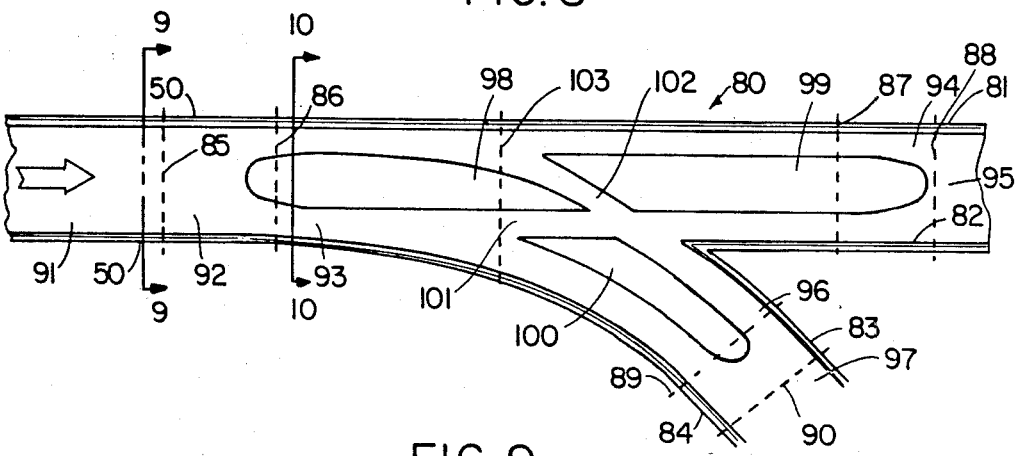
FIG. 9
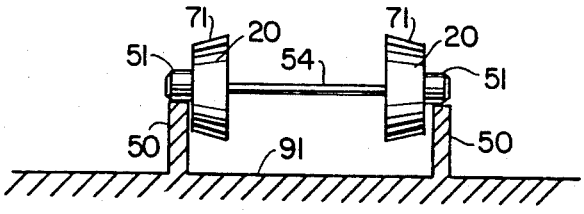
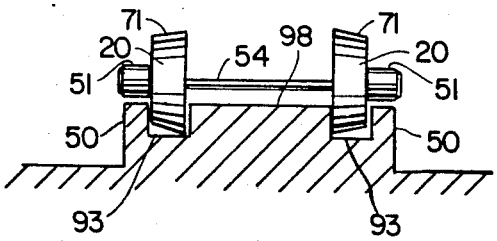
FIG. 10

TRACK INTERSECTION FOR TOY TRAINS

CROSS REFERENCES TO RELATED APPLICATIONS

This application discloses apparatus described and claimed in the following applications all filed the same day as this application and all assigned to the assignee of this invention:

| Title | Inventor(s) | Application No./Filing Date |
|---|---|---|
| Toy Railroad Vehicle Brake System | Nicholas DeAnda<br>Thomas H. Grimm | 06/568,662, January 6, 1984 |
| Toy Railroad Vehicle With Alignment Bias | Eugene J. Kilroy<br>James E. Morse<br>Thomas H. Grimm | 06/570,132, January 12, 1984 |

TECHNICAL FIELD

This invention relates generally to toy railroad trains and particularly to those suitable for use by extremely young children.

BACKGROUND ART

Toy train sets which are replicas of standard railroad systems are popular among many age groups and vary greatly in structure. However, all include a plurality of cars and a miniature locomotive which are used in combination with a track system. Over the years such toy train sets have taken many forms. For example, many such miniature railroads provide the use of a self-powered locomotive which pulls and/or pushes one or more miniature railroad cars through the associated trackway. Also known in the art are so called gravity powered train sets in which the locomotive and other cars are not self-powered but rather travel the trackway using the kinetic energy achieved by traveling a downwardly sloping track portion. The latter form are generally free-wheeling and are often played with by children actually holding onto the locomotive or miniature railroad cars and moving it along various track portion. It is not uncommon for users, particularly young children, to experience difficulty in placing such toy trains upon their tracks. As a result, there exists a need for a toy train system in which the demands of skill required to place a car upon the track are low enough to permit successful placement by a young child.

SUMMARY OF THE INVENTION

Accordingly it is an object of the present invention to provide an improved track intersection for a toy railroad vehicle.

In accordance with the invention there is provided a track intersection for use in combination with a toy railroad vehicle having a plurality of equally spaced wheel pairs wherein each wheel defines an inner rolling surface and an outer rolling surface having a diameter reduced from said inner rolling surface, in which a rail pair divides into diverging rail pairs in which as the intersection is approached the inner rail roadbed rises from a first height at which the toy vehicle rides on the outer rolling surfaces to a second height at which the toy vehicle rides on the inner rolling surfaces.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

FIGS. 1*a* and 1*b* set forth top and elevation views respectively of a toy train car constructed in accordance with the present invention.

FIG. 1*c* sets forth a pictorial detail of the bias spring coupling platform of the present invention toy train set.

FIG. 8 is a plan view of a toy train track intersection.

FIGS. 9 and 10 are section views of the track intersection shown in FIG. 8.

DESCRIPTION OF THE PREFERRED EMBODIMENT

Figure 2:
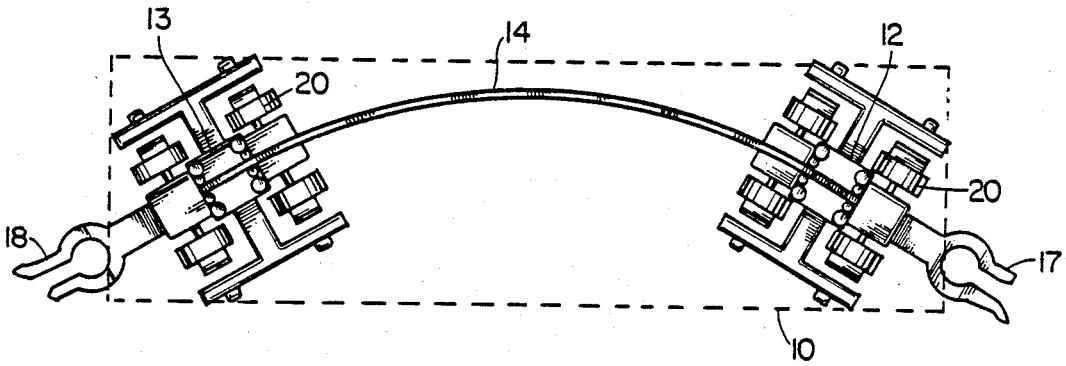
FIG. 2 is a top view of a toy train car, constructed in accordance with the present invention, traversing a curve section of track.

Referring to FIGS. 1*a* and 1*b*, a toy train car constructed in accordance with the present invention includes a rigid generally flat chassis member 10 through which a pair of shaft members 22 and 24 extend. Shafts 22 and 24 are terminated on their upper ends by a pair of spring platforms 13 and 12 respectively and on their lower ends by a pair of truck cross members 45. The details of truck assemblies 70 are set forth below in greater detail. However, suffice it to say here each includes a quartet of track wheels 20 arranged in pairs upon axles passing through a pair of lateral supports 21 on each side of the truck assemblies. In addition, each truck assembly 70 includes couplers 17 and 18 for connecting the car to other similar cars to form a train. Spring platforms 12 and 13 are rigidly coupled by shafts 24 and 22 respectively to their associated truck assembly such that any motion of or force applied to the spring platforms is transmitted by rotation of shafts 24 and 22 to the truck assemblies 70 and will cause a corresponding rotation of the associated spring platform.

An elongated beam spring 14 extends between spring platforms 12 and 13. The manner in which beam spring 14 is supported by and coupled to spring platform 12 and 13 is better understood by turning for a moment to FIG. 1*c*. FIG. 1*c* shows the details of spring platform 13 and one end of beam spring 14 in pictorial fashion. It should be noted that spring platform 12 is of identical construction to that of spring platform 13. Spring platform 13 defines a generally flat planar member 37 having a generally rectangular shape and a quartet of upwardly extending cylindrical members 35 positioned at its corners. Adjacent each cylindrical member 35 is a thinner and somewhat higher cylindrical member 36 which is positioned along the shorter sides. As mentioned above, shaft 22 is rigidly attached to platform 37 (for example by a single piece molding in which a junction 38 shown in dotted lines is formed by the intersection of shaft 22 and the underside of planar member 37). Beam spring 14 passes through the spaces between members 36 and extends a short distance beyond planar member 37.

The space between members 36 is great enough to provide a loose fit for beam spring 14. This permits movement of beam spring 14 in the direction shown by arrow 41. The importance of this motion of beam spring 14 will be explained below in greater detail.

Returning now to FIGS. 1*a* and 1*b*, chassis 10 defines a pair of upwardly extending substantially rectangular members 15 and 16 positioned upon chassis 10 on opposite sides of spring platforms 12 and 13. Rectangular members 15 and 16 serve the purpose of limiting the longitudinal movement (that is along the direction shown by arrow 41 in FIG. 1*c*) of beam spring 14.

Referring now to FIG. 2 which sets forth beam spring 14 and truck assemblies 70 of the toy train car of FIGS. 1*a* and 1*b* as they would appear when truck assemblies 70 are not in straight alignment. This would occur, for example, during the traversing of a trackway curve. Chassis 10 is shown in dotted line fashion in FIG. 2 for purposes of clarity to permit examination and discussion of truck assemblies 70, spring platforms 12 and 13, and beam spring 14 during rotation of the truck assemblies. When truck assemblies 70 are not in straight line alignment, as shown in FIG. 2, the rotation of assemblies 70 causes a corresponding rotation of spring platforms 12 and 13 which because of the above described support of beam spring 14 within spring platform 12 and 13 bends each end of the beam spring causing it to flex, that is to become bent from its normal straight line configuration. Because beam spring 14 is made from a resilient spring material for example, plastic, it exerts an opposing force when bent from its straight line position urging spring platforms 12 and 13 toward the straight line arrangment shown in FIGS. 1*a* and 1*b*. If the rotations of truck assemblies 70 are caused by a force greater than the opposing spring force of beam spring 14, for example, if truck assemblies 70 are restrained within the tracks of the present invention toy train set, beam spring 14 will remain in a flexed position. However, in the absence of such a counter force beam spring 14 will urge truck assemblies 70 back into a substantially straight line arrangement as shown in FIGS. 1*a* and 1*b*.

In operation, this action of beam spring 14 cooperating with spring platforms 12 and 13 to impart a force urging truck assemblies 70 toward straight alignment greatly facilitates the placemnt of the toy train car upon the tracks. In the event the toy train car has become improperly situated with respect to its track or has been removed from the track, the toy train car may be moved to a position above a straight portion of the track. Once the present invention toy train car is raised by a lifting force exerted upon chassis 10, truck assemblies 70 are free to move and, under the above-described urging of beam spring 14, a spring force is exerted upon spring platforms 12 and 13 toward the straight line configuration shown in FIGS. 1*a* and 1*b*. Shafts 22 and 24 couple the torsion force operative upon spring platforms 12 and 13 to truck assemblies 70 to bring them into a straight line arrangement. Once this straight line configuration has been permitted to return through the action of spring 14, it is a relatively simple matter to lower the miniature railroad car into proper position upon the miniature railroad track free of concerns about the individual truck alignments. As will be described below in greater detail, the configuration of wheels 20 are specially designed to further ease the process of lowering the toy train car to its proper position upon the tracks. It should be noted that the spring constant for beam spring 14 is selected to exert sufficient force to urge truck assemblies 70 into straight alignment in the absence of any counter force and on the other hand to be low enough that truck assemblies 70 may rotate with sufficient freedom to permit the toy train car to follow the normal curved contours within the track.

Figure 4:
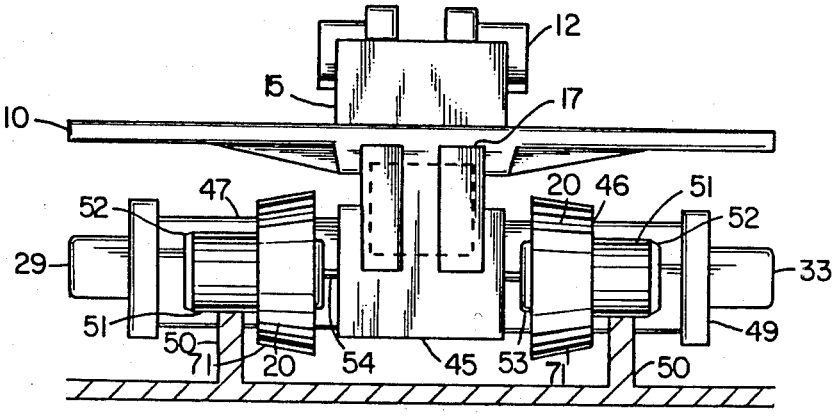
FIG. 4 is a front view of a toy train car constructed in accordance with the present invention supported by a pair of track rails.
Figure 3:
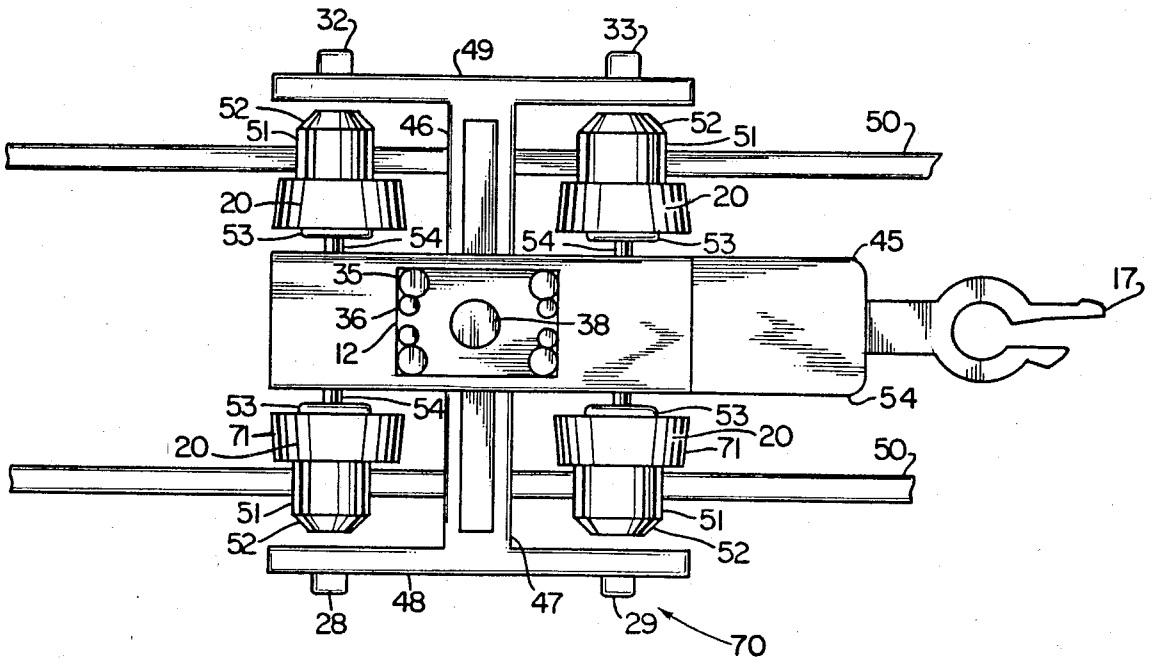
FIG. 3 is a top view of a four wheel truck assembly of the present invention toy train positioned upon a pair of track rails.

Referring to FIGS. 3 and 4 which show in greater detail top and front elevation views, respectively, of truck assemblies 70 positioned in proper alignment with a pair of raised tracks 50. While chassis 10 is shown in FIG. 4, for purposes of description it has not been shown in FIG. 3 in order that close inspection and description of the truck assembly may be made. Truck assembly 70 comprises a center support 45 which extends parallel to the direction of travel and supports a pair of perpendicular arms 46 and 47 extending from the middle of center support 45 beyond tracks 50 and terminating in a pair of lateral arm members 49 and 48 respectively. Lateral member 49 supports a pair of hub members 32 and 33 and lateral members 48 supports a pair of hub members 28 and 29 the function of which will be set forth below in greater detail. A pair of axles 54 pass through center support 45 in perpendicular alignment to the direction of travel. Each axle supports a pair of track wheels 20.

In accordance with an important aspect of the present invention, each of track wheels 20 define two concentric rolling surfaces. The first rolling surface 71 has a large diameter while the second concentric circular surface 51 has a smaller diameter. Rolling surface 51 is the normal rolling surface when the toy train is riding upon the upper portion of the track rails 50 (i.e., trackway operation of the present invention toy train set). Wheels 20 each also define a chamfered surface 52 at the outer end of surface 51 and a bearing surface 53 adjacent the interior side of larger diameter surface 71. Because the wheels are freely moveable upon axles 54 lateral motion of the wheels with respect to center support 45 would but for bearing surface 53 bring the wheels against the center support. However, bearing surface 53 limits the lateral motion of the wheels and permits continued free turning action thereof. This enables the toy car to continue rolling when subjected to lateral forces.

In accordance with an important aspect of the present invention toy train set, it should be noted that the construction of wheels 20 differ significantly from those of the prior art in that rolling surface 71 provides a suitable rolling surface for wheels 20 in the event the present invention train set is operated on a trackless surface such as a hardwood floor or table surface. Prior art toy train wheels more closely duplicate those of standard railroad cars in that a thin narrow often sharp-edged inner-flange is used to maintain the wheels within the tracks which tend to mar surfaces upon which they are used. In contrast, the substantially broader surfaces 71 of wheels 20 of the toy train car permits operation in non-tracked environments set forth above without the problems of surface marring. In addition, prior art toy train wheels due to this narrow flange tend to slide laterally on trackless surfaces rather than follow the preceeding cars in the train. In contrast, rolling surfaces 71 are more suited to such trackless environments because the greater riding areas of surfaces 71 create greater friction with the play surface causing the lateral motion due to sliding to be substantially reduced. Further, the greater breadth of rolling surfaces 71 distributes any loading forces, applied by the child for example leaning upon the train set, across a greater surface reducing the marring of the playing surface and/or damaging the wheels themselves.

In addition to facilitating play upon trackless surfaces, the configuration of the present invention train wheels presents substantial advantages in the placement of the present invention toy train car upon tracks 50. Examination of FIG. 4 reveals that the widths of surfaces 51 and 71 of wheels 20 have been selected with respect to the spacing of rails 50 to provide that even though substantial misalignments of wheels 20 with respect to rails 50 occur to the extent that surface 51 rides upon the upper surface of rail 50 on one side to the truck the extended size of riding surface 51 of the other wheel on the axle will cause rail 50 to nontheless contact the appropriate riding surface 51. In the presence of such misalignment, the slope of surface 51 cooperates with the riding surface of rail 50 to urge a corrective lateral motion of truck assembly 70 of the misaligned wheel and toward the interior of rails 50. This in turn brings surfaces 51 of both wheels to bear upon the upper surface of rails 50. Younger children because of their limited skill and dexterity, often expereince great difficulty in placing such miniature railroad toys upon the track. Therefore, the advantages of such a self aligning tendency in connection with a toy train car are particularly suitable for play by younger children.

Figure 5:
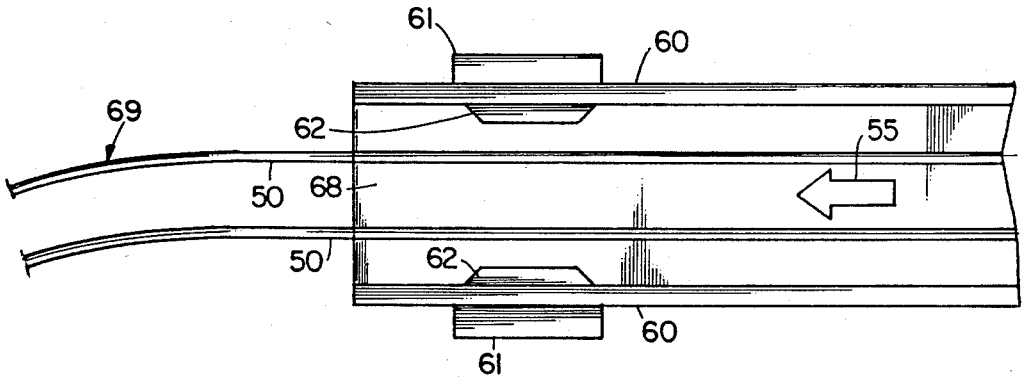
FIG. 5 is a top view of a portion of track roadbed constructed in accordance with the present invention showing car brake assembly.

FIG. 5 shows a portion of the trackway constructed in accordance with an important aspect of the present invention toy train in which a pair of rails 50 are parallely spaced and traverse a road bed portion 58 and a track curve 69 in the direction of travel shown by arrow 55. Road bed 68 is bounded on both sides by a pair of raised walls 60 which are shown in greater detail in FIGS. 6 and 7. Wall portion 60 further defines a pair of cavities 61 positioned opposite each other on each side of rails 50. The structure of cavities 61 is set forth in greater detail in FIGS. 6 and 7. However, suffice it to note here that cavities 61 and wall section 60 support a pair of brake shoes 62 on opposite sides of track rails 50. Again, the details of construction and assembly of wall portions 60 cavity 61 and brake shoes 62 is set forth in greater detail in FIGS. 6 and 7. However, it should be noted with respect to FIG. 5 that the assembly thus formed is located ahead of a curved track portion 69. The relationship in FIG. 5 is intended to be illustrative of a typical trackway structure in which the character of track configuration (i.e., curve 69) makes it desirable to reduce the speed of a toy train traveling through roadbed portion 68 before it encounters curve 69.

Figure 7:
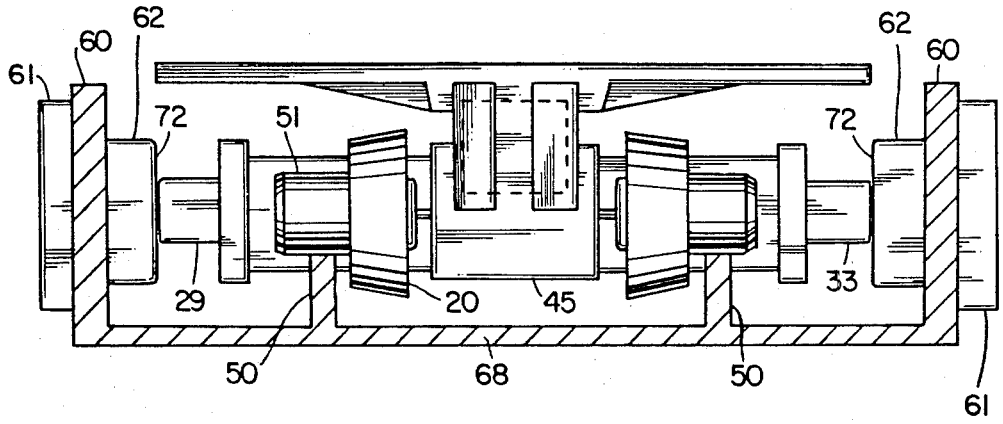
FIG. 7 is a partially sectioned front view of a toy train car constructed in accordance with the present invention and being acted upon by the car brake assembly shown in FIGS. 5 and 6.
Figure 6:
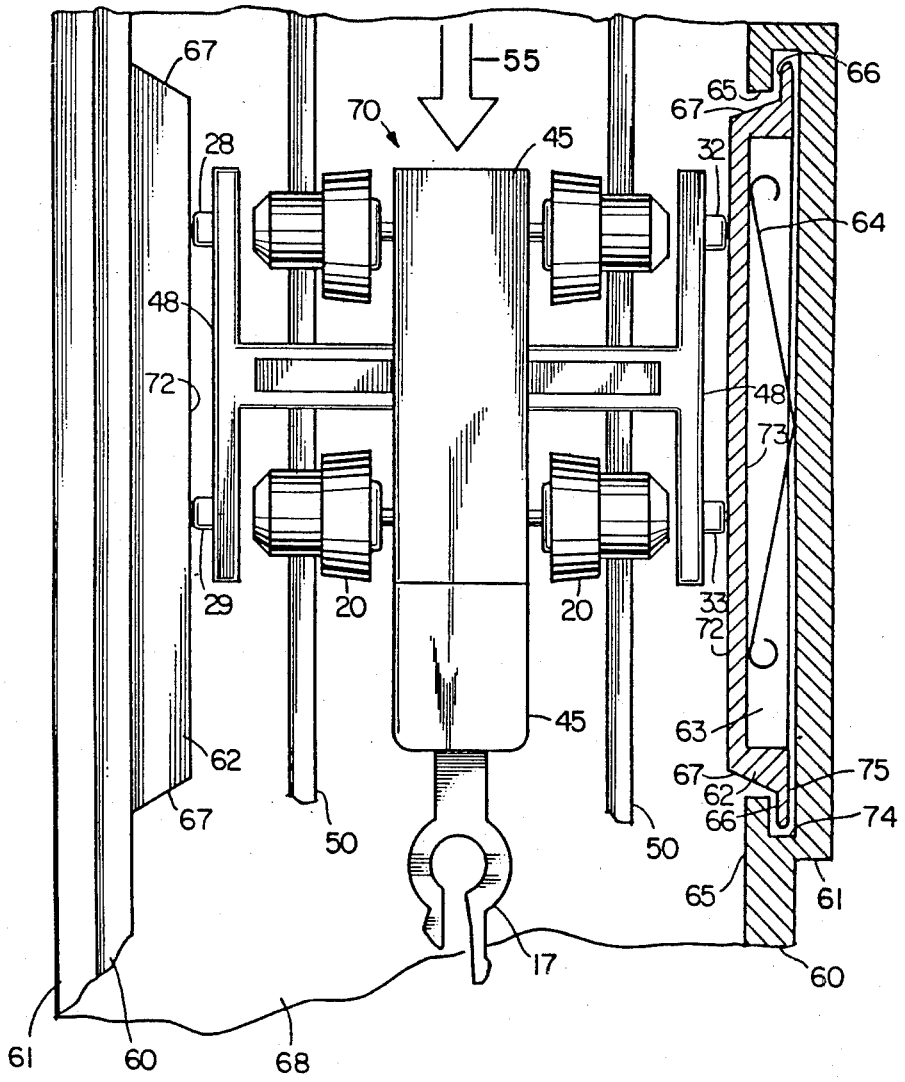
FIG. 6 is a partially sectioned top view of the brake assembly of FIG. 5 acting upon a truck assembly.

Referring now to FIGS. 6 and 7 in which a single truck assembly of the present invention toy train is shown in position between brake shoes 62 traveling the direction of arrow 55. FIGS. 6 and 7 asssume that the truck assembly shown is that of a toy train car traveling with sufficient velocity in the direction of arrow 55 to be acted upon by the brake assembly upon truck assembly 70 in reducing the speed of the passing toy train car and then pass on toward curve 69. At this point attention is directed to the sectioned portion of FIG. 6 in which wall portion 60 and cavity 61 are shown in detail. Wall portion 60 defines cavity 61 and an extension 65. The latter defines an aperture in wall section 60 sufficiently large to permit movement of brake shoe 62 with respect to wall section 60 in a direction perpendicular to track 50 (i.e., toward or away from the track). Brake shoes 62 further define an internal cavity 73 and a pair of flanges 66 which extend beneath numbers 65 and in cooperation with extensions 65 captivate brake shoe 62 within cavity 61 of wall 60. A generally V-shaped spring 64 is positioned within cavity 73 with its open side toward brake shoe surface 72 and its apex against surface 74. Spring 64 is flexed (i.e., opened beyond its normal configuration) and exerts a force urging brake shoes 62 inwardly. In the absence of truck 70, flanges 66 of brake shoe 62 abut extensions 65 and thereby limit the travel of brake shoe 62 in the inward direction. The travel of brake shoe 62 in the outward direction is limited by contact between backwall 74 of cavity 61 and back surface 75 of brake shoe 62. It should be noted that because spring 64 bears upon surface 74 of cavity 61 at a single point, brake shoe 62 may rock or pivot about the bearing surface of spring 64 against surface 74 within the limits of travel of flange 66 between surface 74 and member 65.

In operation as a toy train car proceeds along track 50 in the direction of arrow 55 and approaches the surfaces 67 of brake shoe 62, the leading edge of hubs 29 and 33 simultaneously impact inclined surfaces 67 of brake shoes 62 on both sides of trackway 68. The slope of surfaces 67 and the symmetry of the brake assembly tend to center truck assembly 70 with respect to the brake shoe. The forward momentum of the toy train car causes a friction force to be imparted by hubs 29 and 33 to surfaces 67 of brakes shoes 62. In addition, the force of hubs 29 and 33 against surfaces 67 initially causes brake shoes 62 to pivot. Springs 64 within cavities 73 flex allowing brake shoes 62 to be driven outwardly by hubs 29 and 33. As the car continues forward due to its kinetic energy and momentum hubs 29 and 33 slide across inclined surfaces 67 and onto brake surfaces 72 on brake shoes 62. During this time, a sliding friction is created by hubs 29 and 33 initially against surfaces 67 and then against braking surfaces 72 of brakes shoes 62. This frictional force absorbs a portion of the kinetic energy of the toy train car. As the cars momentum carries it on in the direction of arrow 55, the rearward set of hubs 28 and 32 of truck assembly 70 also are brought into contact with inclined surfaces 67 of brake shoes 62 and in a manner similar to that of hub surfaces 29 and 33 cause a further parting of brake shoes 62 and pivoting back to their parallel alignment. Once hubs 28 move from surfaces 67 to braking surfaces 72 of brake shoes 62, the truck assembly reaches the position within brake shoes 62 in accordance with the depiction in FIGS. 6 and 7. At this point, the friction between all four hubs and the brake shoes is maximum and hubs 28, 29, 32, and 33 slide across braking surfaces 72 reducing the speed of the toy train car. Provided the kinetic energy of the car is sufficient, truck assembly 70 is driven through the closure of brake shoes 62 followed shortly by the clearance of hubs 28 and 32 from surfaces 72. Spring 64 returns brake shoes 62 within cavities 73 to their inwardly extending position. This process is repeated as each truck assembly of the cars making up the toy train passing along trackway 68 encounters brake shoes 62. The total braking force applied to the toy train is the cumulative total of the individual braking forces applied to each truck assembly passing through the brake shoe closure point. A significant advantage of this braking system is found in the result that the total braking force applied to the toy train configuration passing through the braking closure point (that is the number of braking forces applied) is directly proportional to the number of truck assemblies 70 and therefore the number of toy train cars passing through the closure point. In other words longer trains having greater momentum than shorter trains also receive greater braking action.

As can be seen the braking system is fully automatic and needs no attention or activity of operation by the child user. This, of course, is particularly advantageous in the case of younger children who have a minimum skill capability permitting them to judge the velocity which a particular train will negotiate each track section. While FIG. 5 sets forth a single braking system, it will be apparent to those skilled in the art that a plurality of braking systems similar to that shown in FIGS. 5, 6 and 7 may be placed at appropriate places along the trackway to control the speed of the toy train.

In addition to the above-described free-running motion in which the toy train travels unguided down the trackway under force of its own momentum, the toy train shown may be moved along the trackway while being held and guided by a child. In this mode of use, the child may select the path taken at one or more points along the trackway due to the track intersection shown in FIGS. 8, 9 and 10.

FIG. 8 sets forth a track intersection in which a pair of raised rail portions 50 divide into a pair 83 and 84 going off to the right and a pair 81 and 82 continuing straight ahead. As shown and described below in greater detail in connection with FIGS. 9 and 10 a first roadbed portion 91 extends along the trackway to the point delineated by dashed line 85. Thereafter, the roadbed surface from dashed line 85 to dashed 86 forms a rising transition section 92 from the lower surface height of roadbed 91 to an increased height of a raised roadbed section 93. A trio of center islands 98, 99 and 100 are centered between the rail sections and are each raised above the surface of roadbed 93. A downward sloping roadbed section 94 extends from its highest point at dashed line 87 to its lowest point at dashed line 88. Thereafter the height of the roadbed 95 is substantially the same as roadbed section 91. Similarly, a downward transition in the roadbed beginning at dashed line 89 and ending at dashed line 90 forms a transition roadbed section 96 which terminates in a lower roadbed 97. The latter is at the same height as roadbed 91. In other words, as the track intersection is approached the roadbed rises and then drops as the intersection is left. As explained below, the height of islands 98, 99 and 100 is to some extent a matter of design choice. However, it is convenient to raise the islands 98, 99 and 100 to approximately the same height as rail sections 50, 81, 82, 83 and 84.

Referring now to FIG. 9, which is a section taken along line 9—9 in FIG. 8, the relationship between wheels 20 of a toy train car riding upon rails 50 above roadbed 91 is depicted. For purposes of clarity only the wheels, axles, roadbed, and rail section are shown (the latter two are shown in section). It should however be understood that the operation depicted in FIGS. 9 and 10 and the attending discussions is that which takes place between the rails, roadbeds and rolling wheels of a complete toy train car when the intersection of FIG. 8 is traversed. In FIG. 9 it can be seen that the wheels 20 are rolling upon surfaces 51 atop the upper portions of rails 50. This is the normal rolling mode for the majority of the trackway of the toy train of the present invention. Of note is the clearance between wheels surface 71 and roadway 91. In this portion of the trackway, the train is maintained between rails 50 and follows the trackway. As the toy train approaches an intersection 80 it encounters the roadbed transition portion 92. As the wheels travel over transition 92, the clearance between surfaces 71 and roadbed 92 decreases until surfaces 71 are brought into contact with the roadbed. At the upper portion of transition 92 the train begins to roll upon surfaces 71 rather than surfaces 51 in the relationship shown in FIG. 10 which is a section taken along line 10—10 in FIG. 8.

Referring to FIG. 10, wheels 20 at this point roll soley upon raised roadbed surface 93 on the sides of island 98. A space has developed between the top of rails 50 and rolling surface 51 of wheels 20. Therefore, the toy train is at this point of track intersection 80 riding within the portion of roadbed 93 bounded on the outer sides by rails 50 and on the inner sides by raised island 98. As the toy train is moved along track intersection 80 reaching the point approximately indicated by dashed line 103, spaces 101 and 102 in the roadbed separating island 98 from island 100 and island 99 respectively permit wheels 20 to travel in a straight line path through the space 101 and thereby continue in a straight direction toward transition portion 94. Alternatively, under the urging of the child guiding the toy train, the lead vehicle in the train may be guided in what amounts to a right hand turn through space 102 between islands 98 and 99 thereby passing over island 100 through transition roadbed portion 96 to tracks 83 and 84 overlying roadbed portion 97 and thereafter continuing on tracks 83 and 84.

It should be noted by briefly returning to FIGS. 1*a* and 1*b* as well as FIG. 2 that the normal operation of the toy train of the present invention envisions the serial coupling of a plurality of such toy train cars. As will be recalled in the discussions attendant FIG. 2, the truck assemblies of each toy train car are rotatable in conformity to track curvature. With this in mind and returning to FIG. 8 it will be apparent that once the initial car in such a string of coupled toy train cars has been guided either straight ahead or in a right hand turn through track intersection 80, the remaining cars will follow through track section 80 unimpeded due to the availability of alternative paths and the ability of wheels 20 to roll upon surfaces 71 across the upper portion 93 of the track intersection.

As will be readily apparent to those skilled in the art the advantages of the present invention track intersection include the complete absence of moving parts. This is particularly advantageous when the present invention toy train is operated by young children. In addition, since the cooperation of the larger diameter surfaces 71 of wheels 20 and islands 98, 99 and 100 maintain a channel through which the toy train moves and is guided the potential for derailing of the toy train during the traversing of the track intersection is greatly reduced.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. For use in combination with a toy railroad vehicle having a plurality of wheel pairs wherein each wheel defines an inner rolling surface and an outer rolling surface having a diameter reduced from said inner rolling surface, said outer rolling surfaces of said wheels within each wheel pair being spaced by a predetermined distance, a track intersection comprising:

a track intersection region having a first pair of rails spaced apart by said predetermined distance and dividing into a second and third pair of similarly spaced rails;

a raised roadbed section extending between said first, second and third pairs of rails throughout said track intersection region, and having a height with respect to said rails such that said wheels roll upon said inner rolling surfaces, said raised roadbed section including first, second, and third downwardly sloping ramp portions;

a lowered roadbed portion having a height with respect to said rails such that said wheels roll upon said outer rolling surfaces, beginning at each of said ramp portions between said first, second, and third pairs of rails, and extending away from said track intersection region; and first, second, and third islands located between said first, second, and third pairs of rails within said track intersection region; said first, second, and third islands being mutually spaced apart to permit said wheels to roll upon said rolling surfaces from said first pair of rails to either said second or third pair of rails.

2. For use with a toy railroad vehicle having a plurality of wheels arranged in pairs, each wheel having an inner and an outer rolling surface, said wheel pairs having a first predetermined distance between said inner and outer rolling surfaces, said track intersection comprising:

a first roadbed;

a first rail extending upwardly from said first roadbed;

a second rail extending upwardly from said first roadbed, said first and second rails extending to a predetermined height, with respect to said first roadbed and having a first portion in which said first and second rails have a constant interspacing and a second portion in which the spacing between said first and second rails increases gradually as a function of the distance from said first portion, said predetermined height selected to cause said inner rolling surfaces to clear said first roadbed;

a third rail raised to the same height as said first and second rails and having a constant spacing from said first rail;

a fourth rail raised to the same height as said first and second rails and having an intersection with said third rail between said first and second rails;

a second roadbed raised from said first roadbed to a second predetermined height such that said wheels roll upon said inner rolling surfaces, said second roadbed extending throughout said second portion of said first and second rails;

first, second, and third ramp portions between said first and second roadbeds forming a transition therebetween; and first, second, and third islands extending above said second roadbed and placed respectively between said first and second rails, said first and third rails, and said second and fourth rails.

* * * * *